US008196928B2

(12) United States Patent
Thomopoulos

(10) Patent No.: US 8,196,928 B2
(45) Date of Patent: Jun. 12, 2012

(54) FOOTBALL GAME

(75) Inventor: Nick T. Thomopoulos, Burr Ridge, IL (US)

(73) Assignee: StatoGames, Inc., Burr Ridge, IL (US)

( * ) Notice: Subject to any disclaimer, the term of this patent is extended or adjusted under 35 U.S.C. 154(b) by 0 days.

(21) Appl. No.: 12/906,314

(22) Filed: Oct. 18, 2010

(65) Prior Publication Data

US 2011/0089638 A1 Apr. 21, 2011

Related U.S. Application Data

(60) Provisional application No. 61/252,259, filed on Oct. 16, 2009.

(51) Int. Cl.
*A63F 3/00* (2006.01)

(52) U.S. Cl. ..... 273/247; 273/259; 273/277

(58) Field of Classification Search ..... 273/244, 273/247, 259, 277
See application file for complete search history.

(56) References Cited

U.S. PATENT DOCUMENTS

| | | | | |
|---|---|---|---|---|
| 1,701,655 | A | 2/1929 | Andrews | |
| 2,060,973 | A | 11/1936 | Brown et al. | |
| 2,064,466 | A | 12/1936 | Downey | |
| 2,106,846 | A | 2/1938 | Katz | |
| 3,730,528 | A | 5/1973 | Corrado | |
| 4,003,580 | A | 1/1977 | Haffey et al. | |
| 4,094,509 | A | 6/1978 | Barron | |
| 4,120,503 | A * | 10/1978 | Macrory et al. | 273/244 |
| 4,173,346 | A | 11/1979 | Godwin | |
| 4,285,521 | A * | 8/1981 | Joel, III | 273/247 |
| 4,660,836 | A | 4/1987 | Rhome | |
| 4,773,650 | A | 9/1988 | Doughty | |
| 5,040,796 | A | 8/1991 | Schall | |
| 5,158,301 | A | 10/1992 | Martukovich | |
| 5,405,141 | A | 4/1995 | Wilkes | |
| 5,451,050 | A | 9/1995 | Charles | |
| 5,496,036 | A | 3/1996 | Chester | |
| 5,746,431 | A | 5/1998 | McIntyre et al. | |
| 5,755,441 | A | 5/1998 | Langan et al. | |
| 7,334,796 | B2 * | 2/2008 | Wittwer | 273/277 |
| 2004/0066002 | A1 | 4/2004 | Spring | |
| 2006/0214370 | A1 * | 9/2006 | Schneider | 273/244.2 |

OTHER PUBLICATIONS

CSE Games, "Card Football: Premiere Edition", Sep. 23, 2009, Publisher: www.csegames.com.

Crawford, Scott, "Card Bowl—Playing Card Football", Sep. 23, 2009, Publisher: www.cardbowl.org.

* cited by examiner

*Primary Examiner* — Vishu K. Mendiratta
(74) *Attorney, Agent, or Firm* — Blanchard & Associates

(57) ABSTRACT

A game is provided that simulates American style football. Action cards include offensive plays and defensive outcomes. Skill is introduced by the offensive play chosen by an offensive player. Chance is introduced by the defensive outcome corresponding to the offensive play selected by the offensive player. The game lacks dice, spinners, or other random number generators. The game includes one set of action cards, which are selected consecutively by the offensive player. As preferably listing only offensive plays, only the defensive outcomes, thus the results of the offensive plays, vary from card to card. The game includes a field with markers that may be used to track the progress of the game.

14 Claims, 4 Drawing Sheets

FOOTBALL GAME

REFERENCE TO RELATED APPLICATIONS

This application claims the benefit of U.S. Provisional Application No. 61/252,259 entitled "Football Card Game" filed Oct. 16, 2009, which is incorporated by reference in its entirety.

BACKGROUND

Many games have been proposed to mimic American style football. Some require complex boards, spinners, look-up-tables, timers, and the like to track the progress of the game or to introduce chance. It would be beneficial to have a game that replicates in many ways the game of football, while relying on a single deck of action cards.

SUMMARY

A game for simulating American football includes action cards including offensive plays and defensive outcomes, where the action cards include a chance element of the game and the chance element is introduced by different defensive outcomes for the same offensive plays; a field simulating an American football field; and markers that removably attach to the field to monitor the progress of the game, and where the game is played by consecutively drawing the action cards and plotting the defensive outcomes of the offensive plays with the markers on the field. The action cards may include the same offensive plays and different defensive outcomes. The game may be incorporate into one or more electronic devices.

The offensive plays and the defensive outcomes of the action cards may be incorporated into one or more data table stored in an electronic device. The field and the markers may be represented graphically on a display of the electronic device. The display may be a touch screen and the offensive plays may be selected by tapping the touch screen.

The field and the markers of the game may be provided by score or status commands entered into the electronic device. The offensive plays may be selected by sending a command through the electronic device to a remote server. Two or more users may follow the progress of the game through the remote server.

The scope of the present invention is defined solely by the appended claims and is not affected by the statements within this summary.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION

By focusing on offensive strategies and defensive chance, the present invention provides a game having simplicity and rapid play. As the game involves strategy, but continues at a rapid pace, both older and younger players remain interested. As the complete game is sized similarly to a deck of cards, it is compact enough to be carried on the person. In play, only space for a small field and the cards is needed.

The game reduces offensive play to a finite set of specific options, as described further below. Each of the possible offensive plays is presented on each action card. Thus, only the defensive plays, or "outcomes," change from card to card. In this manner, offense is by strategy, while defense is by chance. There is one deck of action cards, preferably including 78 cards, which is consecutively drawn from by the offensive player after calling each play. Thus, the players do not have the discretion to "select" a card from multiple possibilities, instead drawing the next consecutive card from the deck.

As the defensive outcomes vary from card to card, dice, spinners, and other random number generators are unnecessary to introduce the element of chance into the game. The defensive outcome of a selected offensive play is dictated by the next consecutive card in the deck, thus the game does not involve guessing, card matching, or other elements where the players play against each other. Instead, the offensive player plays against the chance of the deck, while the defensive player "rests". In this manner, the game remains interesting to younger players as they can effectively play by simply calling plays when it is their turn to at offense. While a two-player game is envisioned, in fact, only one player "plays" at a time.

Figure 1:
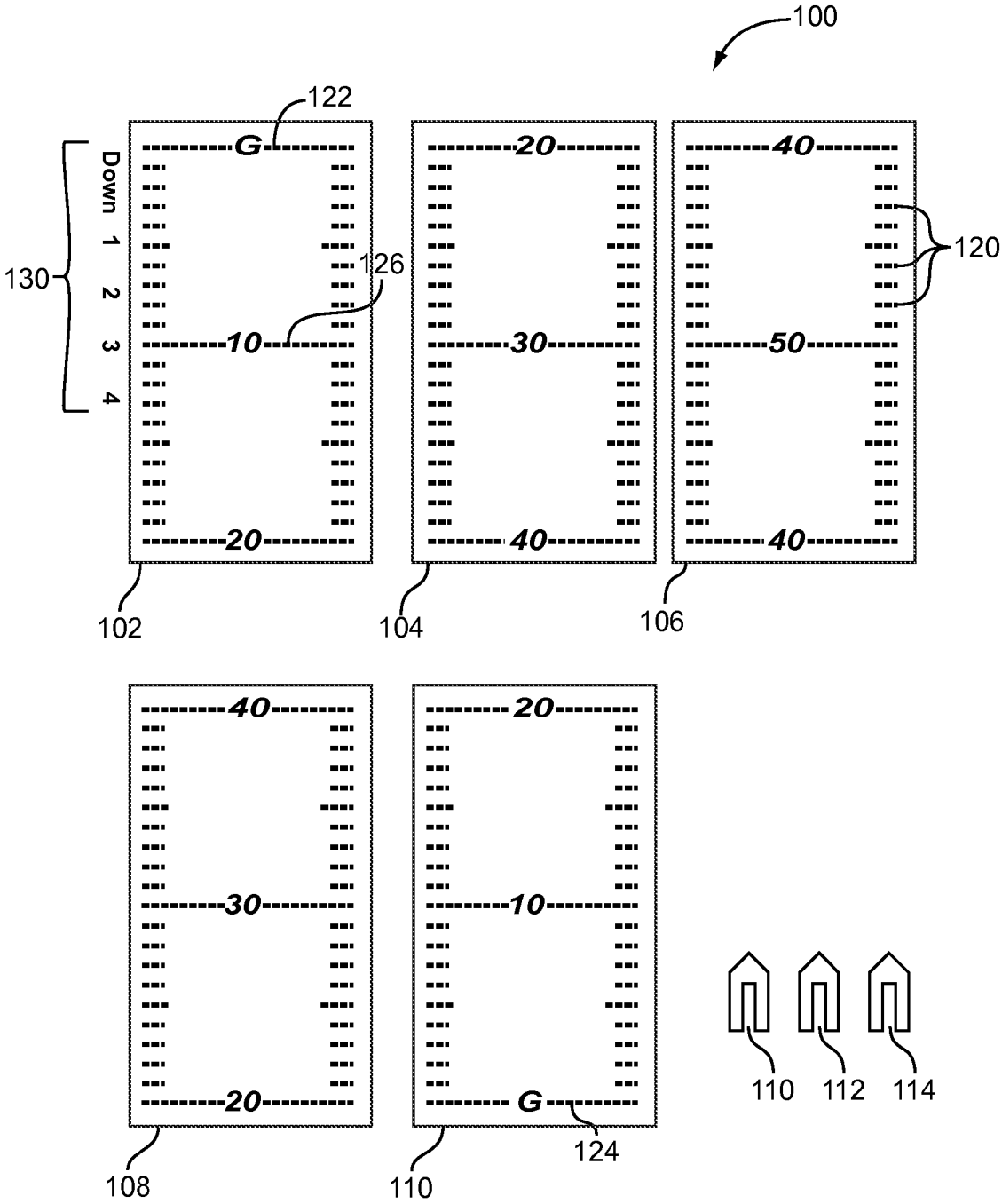
FIG. 1 depicts five cards that when joined together end-to-end, such as with transparent adhesive tape, provide a foldable game board or simulated playing field.

FIG. 1 depicts five cards 102, 104, 106, 108 and 110 that when joined together end-to-end, such as with transparent adhesive tape, provide a foldable game board or simulated playing field 100. The field 100 as formed from the cards includes 101 marks 120 between opposing end zones 122, 124. Each of the five cards identifies twenty yards of the field in the following way: (0 to 20, 20 to 40, 40 to 40, 40 to 20, 20 to 0). Numerical yard indicators 126 may be positioned every 10 yards or at other intervals. Ball position 110, first down 112, and down 114 markers may be provided that may be slid along the field 100 to keep track of the game as play progresses. The ball position 110 and the first down 112 markers may be slid along the longitudinal length of the 101 marks 120 on the field 100 to simulate ball movement along the 100 yards of a football field. Preferably, the markers are different colored clips that bind with the upper and lower surfaces of the cards. The card 102 also includes the four downs (1, 2, 3, 4). During play, the down 114 marker is slid longitudinally along the Down 1, 2, 3, and 4 indicators 130 on the card 102. The field 100 may include additional cards and/or markings.

Figure 2:
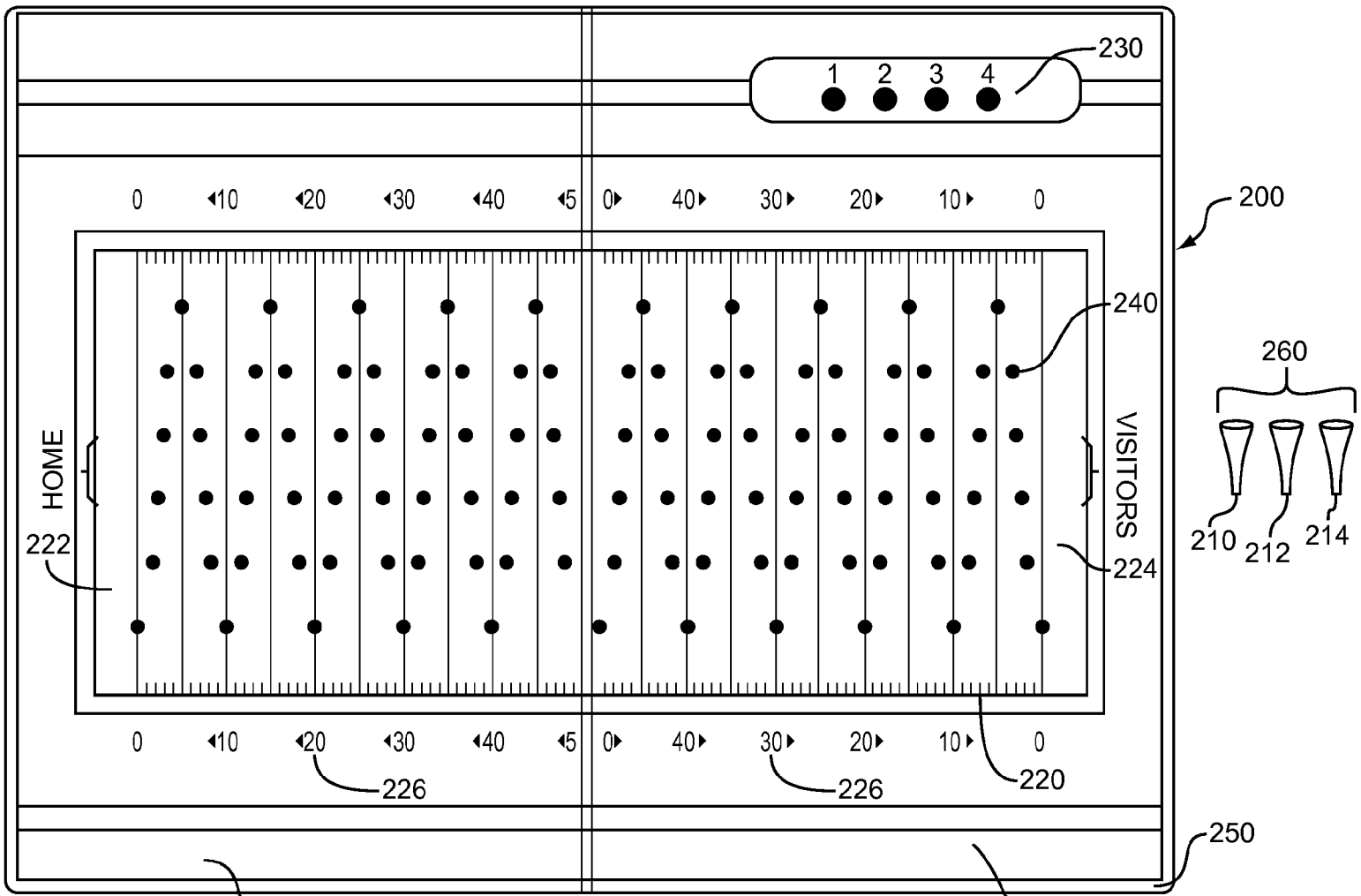
FIG. 2 depicts a game board or simulated playing field formed from two substrates, where the substrates have a thickness sufficient to support pins inserted in holes punched through the substrates.

FIG. 2 depicts a game board or simulated playing field 200 formed from two substrates 202 and 204, where the substrates have a thickness sufficient to support markers 260 inserted in holes 240 punched through the substrates 202, 204. Each substrate is preferably about the size of two playing cards when the playing cards are placed side-to-side. The substrates 202, 204 may be placed in a sheath 250, which is transparent on its top side and opaque on its bottom side. Thus, printing on the substrates 202, 204 may be seen through the top side of the sheath 250, but not though the bottom side. The holes 240 are also punched though the top side of the sheath, but not through the bottom side of the sheath 250. In this way, the markers 260 may be inserted though the top side of the sheath 250 and held in the holes 240 punched in the substrates 202, 204, but not be visible or extend though the bottom side of the sheath 250. Preferably, the markers 260 are different colored plastic pins that taper from top to bottom.

The field 200 as formed from the substrates 202, 204 includes 101 marks 220, each corresponding to a hole, between opposing end zones 222, 224. The substrate 202 identifies twenty yards of the field in the following way: (0 to 20, to 40, 40 to 50). The substrate 204 identifies twenty yards of the field in the following way: (50 to 40, 40 to 20, 20 to 0). Numerical yard indicators 226 may be positioned every 10 yards or at other intervals. Ball position 210, first down 212, and down 214 markers may be provided that may be inserted into and held by the holes 240 in the field 200 to keep track of the game as play progresses. The ball position 210 and the first down 212 markers are inserted and removed from the holes representing the 101 marks 220 on the field 200 to simulate ball movement along the 100 yards of a football field. The substrate 204 also includes the four downs (1, 2, 3, 4). During play, the down 214 marker may be inserted and removed from the holes representing the Down 1, 2, 3, and 4 indicators 230 on the substrate 204. The field 200 may include additional components and markings.

Figure 3:
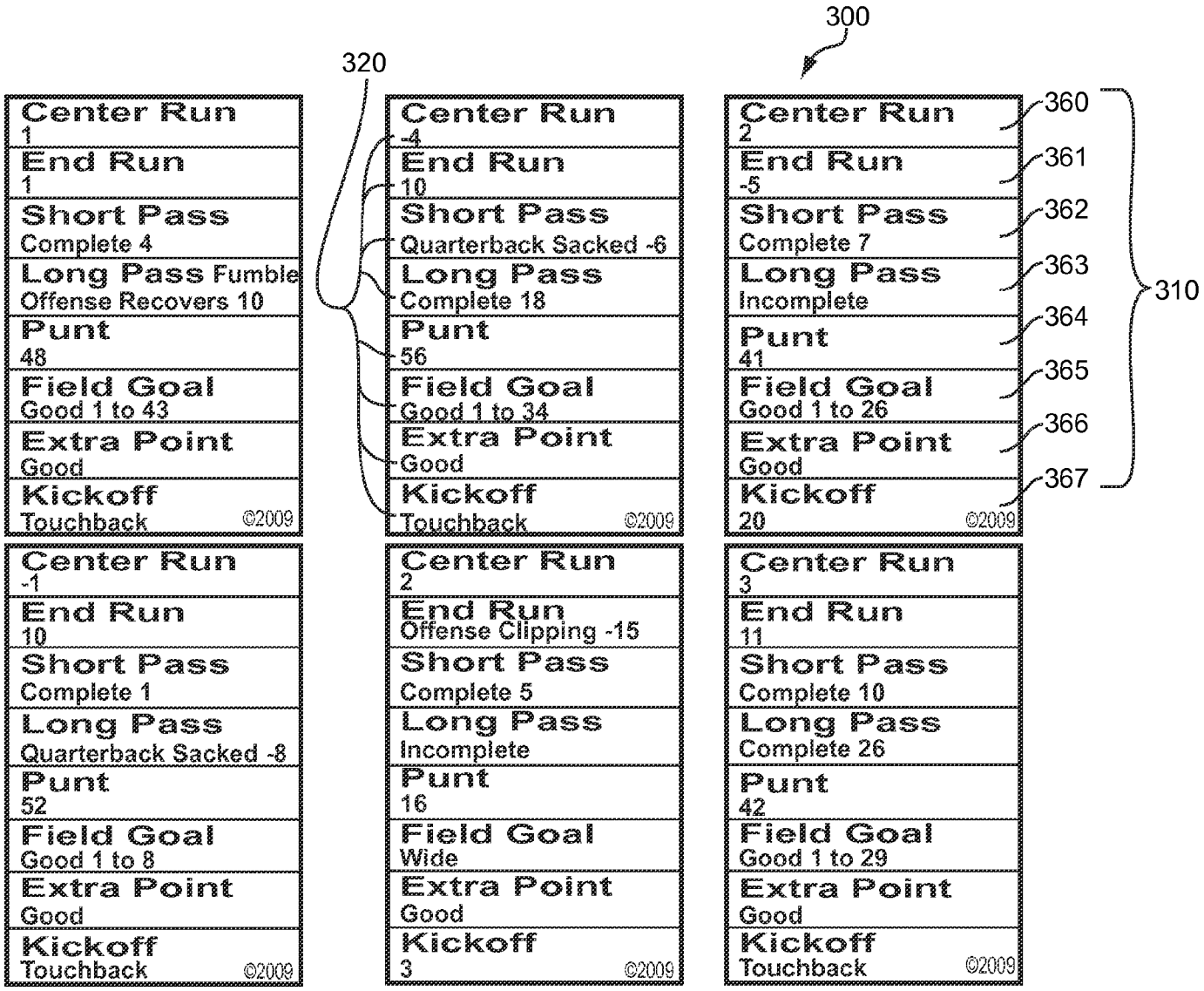
FIG. 3 represents six different action cards that provide offensive plays and defensive outcomes that are used to play the game.

FIG. 3 represents six different action cards 300 that provide offensive plays 310 that are used to play the game. The cards 300 each include eight possible offensive plays, but fewer or additional offensive plays may be provided on the cards 300. Each card has a unique combination of defensive outcomes 320. Preferably, the offensive plays 310 are presented in large text above the smaller text of the defensive outcomes 320 with regard to the longitudinal dimension of the cards 300. Other text orientations are possible. The cards 300 may be printed with identical backs so that when they are placed face down they cannot be distinguished from each other. The cards 300 are preferably the size of conventional playing cards, but other sizes may be used.

Each of the cards 300 includes the same offensive plays 310, with each offensive play having an associated defensive outcome. Preferably, while the offensive plays 310 are the same for each of the cards 300, the defensive outcomes 320 are different for each of the cards 300. A deck of the cards 300 may include thirteen sets of these six cards (78 cards total) to approximate the number of plays in a half.

Although not required, the outcomes of the offensive plays 310 may be implemented to statistically comply with the actual outcomes obtained from a National Football League and/or other series season. For example, the cards 300 could be released based on the 2009 season of NFL play or released as based on the 1997 season. Alternatively, the cards 300 could be provided to statistically comply with the actual statistical outcomes obtained from the historical records of a given team. For example, the cards 300 could represent the "home" 2009 season performance of a given NFL team when playing at home, or the cards 300 could represent the "visiting" records of the teams visiting the given NFL team for that season. In this way, a "home" player could draw from the home cards when playing offense while a "visiting" player could draw from the visiting cards when playing offense. Other cards representing different underlying statistics could be used. However, in each instance, the cards 300 representing the offensive plays for a half are played at a time.

For each of the offensive plays, there are may be seventy-eight defensive outcomes, one defensive outcome for each action card in the deck. The defensive outcome distribution for each play is preferably selected to be representative with the statistics found in the record books of the NFL and NCAAA Football Leagues for prior years. This way, the combinational choice of offensive plays and their corresponding statistically-based defensive outcomes provide a game having realistic results.

Eight preferred offensive plays 310 include: Center Run, End Run, Short Pass, Long Pass, Punt, Field Goal, Extra Point, and Kickoff. A description of each of these offensive plays is as follows; however, other offensive plays and defensive outcomes may be used.

Center Run 360: The ball is run by an offensive player. The defensive outcome 320 shows the net gain or loss with respect to the line of scrimmage. For example, 5 implies a gain of 5 yards, and, −3 implies a loss of 3 yards from the yard marker at the start of the play. A penalty is also possible for the defensive outcome 320 and the team penalized (offensive or defensive) may be listed and the number of penalty yards shown. A fumble is also possible for the defensive outcome 320 and the card names the team that recovers the fumble along with the net yards. Other defensive outcomes may be used.

End Run 361: The ball is run by an offensive player. The defensive outcome 320 shows the net gain or loss with respect to the line of scrimmage. For example, 5 implies a gain of 5 yards, and, −3 implies a loss of 3 yards from the yard marker at the start of the play. A penalty is also possible for the defensive outcome 320 and the team penalized (offensive or defensive) is listed and the number of penalty yards is shown. A fumble is also possible for the defensive outcome 320 and the card names the team that recovers the fumble along with the net yards. Other defensive outcomes may be used.

Short Pass 362: The offensive player calls for a short pass. One of six defensive outcomes 320 can take place: pass complete, pass incomplete, pass intercepted, quarterback sacked, penalty or fumble. The numbers show the net gain or loss relative to the placement of the ball at the start of the play. Other defensive outcomes may be used.

Long Pass 363: The offensive player calls for a long pass. One of six defensive outcomes 320 can take place: pass complete, pass incomplete, pass intercepted, quarterback sacked, penalty or fumble. The numbers show the net gain or loss relative to the placement of the ball at the start of the play. Other defensive outcomes may be used.

Punt 364: This play is when the offensive player calls for a punt. Four defensive outcomes 320 may take place. The first is a punt run-back and the card shows the net yards from the line of scrimmage. If this number places the ball in the end-zone of the receiving team, this is a touchback and the ball is placed on the 20 yard line of the receiving team. The next three defensive outcomes 320 of this play are the following: blocked kicks, penalties and fumbles with the corresponding net yards shown. Other defensive outcomes may be used.

Field Goal 365: This play is used when the offensive player calls for a field goal. Four defensive outcomes 320 occur as follows. The first is when the ball is kicked and the card shows the yards for which the kick is good. For example "Good 1 to 26" states the field goal is good if the line of scrimmage is 26 or less yards from the end zone. Otherwise the kick is not good. If the field goal attempt is outside of the 20 yard line and not good, the defensive team takes possession of the ball from the current line of scrimmage. If the field goal attempt is from within the 20 yard line and is not good, the defensive team takes possession of the ball at the 20 yard line. The next three defensive outcomes 320 are penalty, fumble and blocked kick. Other defensive outcomes may be used.

Extra Point 366: This play is only used in a mandatory extra point situation. The play attempt is from the second yard line. The defensive outcome 320 for the kick is either good or not good. The extra point is worth one point if good. The defensive outcome 320 of a penalty also may result. However, if the offensive player calls for a center run, end run, or short pass as opposed to an extra point in the mandatory extra point situation and reaches the end zone, two points are gained. Other defensive outcomes may be used.

Kickoff 367: This play is only used in a mandatory kickoff situation. The kickoff for this defensive outcome 320 starts from the 30 yard line of the kicking team. Four defensive outcomes 320 occur: first, the ball is kicked and the receiving team returns the ball until tackled and the net yards is shown on the card; second is a touchback and the ball is placed on the 20 yard line of the receiving team; the third and fourth outcomes are penalties and fumbles. Other defensive outcomes may be used.

While other defensive outcomes are possible, a summary of the previously discussed defensive outcomes 320 include gain or loss of yardage, penalty, fumble with turn-over (the defensive player takes the cards and plays offense), fumble with turn-over including a gain or loss of yardage, fumble without turn-over, incomplete pass, incomplete pass with turn-over, quarterback sacked, punt yardage, blocked kicks, maximum yardage for field goal good, extra point good or not good, kickoff yardage, interception, and touchdown.

Figure 4:
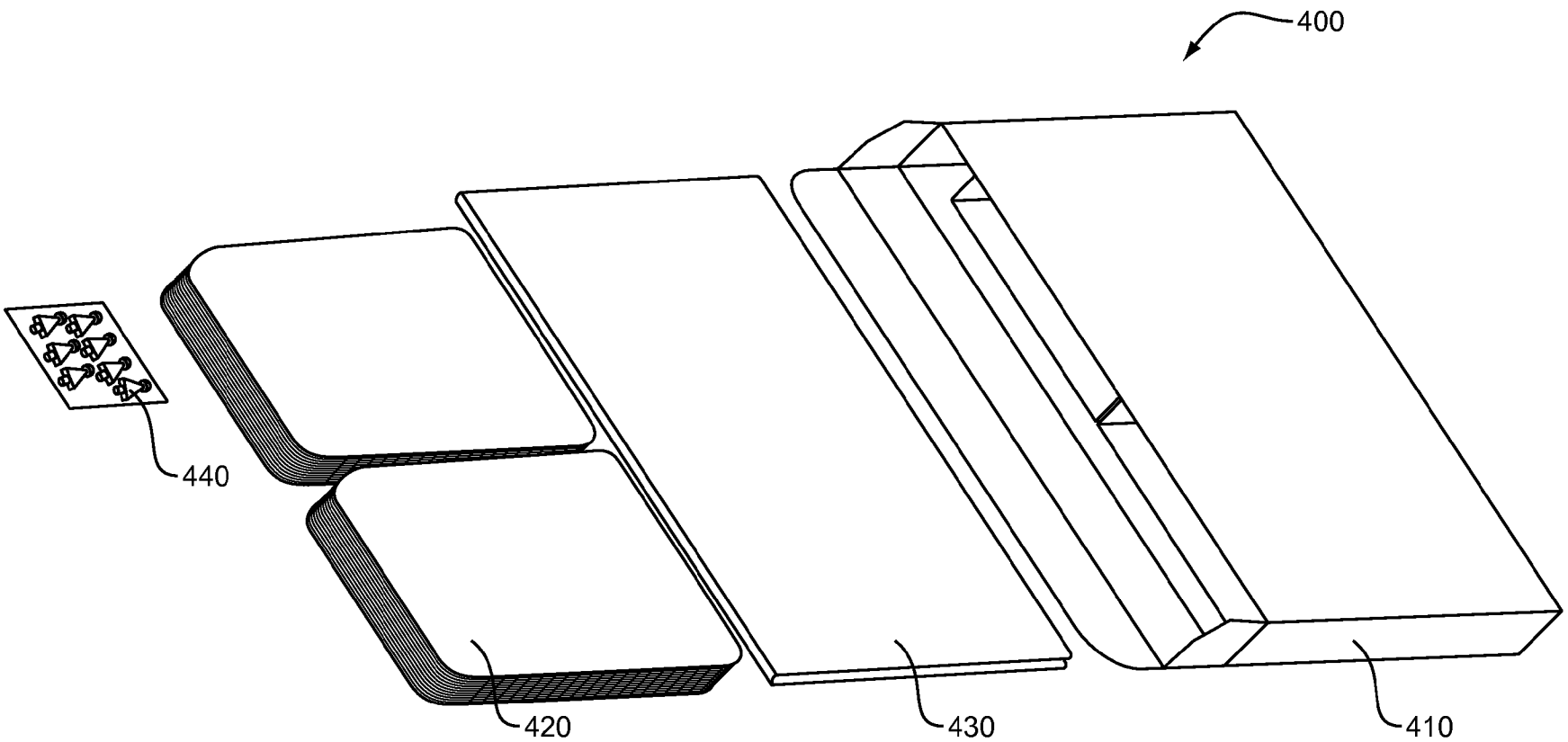
FIG. 4 represents a football card game as including a box containing a field, cards, and markers.

FIG. 4 represents a football card game 400 as including a box 410 containing a field 430, cards 420, and markers 440. The box 410 is about the width of two decks of cards placed side-to-side and about the height of a single deck of cards. The box 410 may have other dimensions as preferred to include the field 430, the cards 420, and the markers 440. The box 410 may be sized and adapted to include additional or other components, including instruction cards, instruction sheets, clips, pins, and the like (not shown). The box 410 also may be about the width of a single deck of cards if the field 430 is assembled from the cards 420 instead of being provided as two substrates in a sheath that folds in the middle. Preferably, the box 410 is sized to fit in the back pocket of a pair of pants, but other sizes are possible.

The field 430 may be made from the cards 420, as previously described with regard to FIG. 1, or provided in the form of two substrates in a sheath that folds as described with regard to FIG. 2. If provided as substrates in a sheath, when folded the bottom side of the sheath is visible on both exterior surfaces of the sheath.

In addition to the action cards providing offensive plays, as previously discussed, the cards 420 may include instruction cards and/or field cards from with the field 430 may be assembled. The card game 400 may include instruction cards regarding how to set up and use the field 430 to play the game, how to form or use the markers 440, and how to play. Other types of instruction cards may included in the game 400. Three examples of possible instruction cards are as follows.

A first card may read: Create the Playing Field: Find the five cards depicting the play field. Arrange the cards in the sequence below where the yard markers are as follows: 0 to 20, 20 to 40, 40 to 40, 40 to 20 and 20 to 0. Now use transparent adhesive tape on the backs of the cards to attach the five cards in a fan-fold manner. The playing field is now complete.

A second card may read: The Card Markers: Find the card with the yard makers. With a scissors cut out the three markers: The line-of scrimmage marker, the first-down marker, and the down-of-play marker. Alternatively, paper clips can be used as the markers.

A third card may read: How to Play: A game consists of two halves. At the beginning of each half, the cards are shuffled and turned face down. A flip of a coin decides the receiving team for the opening kickoff. The coach of the kicking team turns over the first card to determine the outcome of the kickoff. Afterwards, for each play of the game, the coach of the team with possession of the ball calls out the play to use and then turns over the next card to see the outcome of the play. Each half ends when the 78 cards are turned over.

A fourth card may read: Play Descriptions: Center Run & End Run: the net yards gain or loss for the play, fumbles and penalties. Short Pass & Long Pass: complete pass, incomplete pass, interceptions, quarterback sacked, fumbles and penalties. Punt: net yards from the kick and return, fumbles and penalties. Field Goal: the yards to the end zone where the kick is good, fumbles and penalties. Extra Point: lists good, no-good, fumbles and penalties. Kickoff: the net yards of the kick and run back, touchbacks, fumbles and penalties.

A fifth card may read: Introduction: This easy-to-learn, fun-filled, action-packed game follows the same rules as in regular football. The game has 78 unique cards. Each card contains eight sections: Center Run, End Run, Short Pass, Long Pass, Punt, Field Goal, Extra Point, and Kickoff. A 100-yard playing field is provided so the coaches can follow the action. Markers, such as paper clips or pins, may be used to keep track of the position of the ball, the first-down marker and the down of the play.

Method of Play

The cards 420 are removed from the box 410, shuffled, and placed face-down where the offensive plays may not be seen. The markers are used to designate that the first down is starting. A flip of a coin or other method may be used to determine which team will receive the opening kickoff. The kickoff begins on the 30-yard line of the kicking team. The offensive player turns over the first card to determine the outcome of the kickoff. For example, a 45-yard defensive outcome from an offensive play places the ball on the 25-yard line of the receiving team. Then, a marker is slid along the field or inserted into the hole in the field corresponding to the defensive outcome yardage from the offensive play, thus, the 25-yard line of the receiving team. A second marker is slid or inserted 10 yards downfield, representing the first down.

For each offensive play that follows, the offensive player calls out the play and turns over the next card to see the corresponding defensive outcome. The defensive outcome will determine the net yardage. Ball possession changes based on the yardage gained or lost, as in actual football. In other cases, a defensive or offensive penalty may be called. Thus, the game is preferably played in accord with the regulation game of American football and as long as one player draws cards permitting the ball to remain in his or her possession, the other player waits until the first player loses possession of the ball. Possession may be lost through the offensive play of a fumble or interception or by the offensive player failing to advance 10 yards after four plays, for example.

The offensive player has four (4) plays to make a first down or touchdown. The down marker is moved in accord with each play and the yardage marker is slid along the field or removed and reinserted in the holes corresponding to the yardage of the plays. When the offensive team advances the ball beyond the first down marker, a first down is gained and the first down marker is moved. When the offensive player loses the ball, either by having played four cards, by having to punt, or by a turn-over defensive outcome, the offensive player gives the remaining cards to the defensive player. Play continues in this manner until all the cards are turned over to provide sufficient variation in the number of plays and defensive outcomes to approximate the action and offensive strategy of a real football game.

When the offensive team advances the ball past the goal marker, a touch down is gained. If the offensive player calls for a Field Goal, the attempt is good if the kick is long enough to reach the goal line. If the Field Goal is not long enough, the ball is turned over to the defensive team at the line of scrimmage.

Another Kickoff is called after a score (touchdown or field goal) and the Extra Point is called after a touchdown. The first half ends when all the cards are turned over. The offensive player who received the opening kickoff becomes the kicking team and the other player becomes the new offensive player. After the cards are re-shuffled, the second half of the game begins. The game ends when the last card is reached.

The winning player is the one who scores the most points. In case of a tie, a coin toss or other method may be used to determine the receiving player to start a new half. The first team to score is the winner.

Incorporation into an Electronic Device

The football card game may be incorporated into an electronic device, such as an iPhone®, Blackberry®, or related device, and the virtual game may be played similarly as the card game. In an implementation using a touch screen, for example, offensive players pick a play by touching the screen to select one of the available offensive plays. Once the offensive play is selected, the electronic device determines the defensive outcome by providing one of the possible outcomes for the offensive play as previously described. A graphic then appears on the screen of the device illustrating the result of the defensive outcome. The field and markers may be represented graphically on the touch screen of the device.

The quarter, down, ball position, and score may be tracked in simple data structures. The action cards may be transcribed into one or more data table, and when an offensive play is selected, a defensive outcome is chosen at random from the data table, and the results of the play applied. As with the physical card game, the "clock" counts not real time but the number of plays executed. Thus, the offensive plays and available defensive outcomes in the one or more data table are the electronically stored and accessible cards represented in FIG. 3.

Users may play the game on an individual device or can link two devices using a network, or the like. For example, two players can play remotely by using text messaging to send offensive plays between their devices, while both devices display the same ball position.

In a text messaging implementation, for example, a user would register with a remote server. The user would be prompted with text messages, such as "2$^{nd}$ and 8 at your 35 yd line" and would responds by calling an offensive play. The server would then return the result, such as "5 yd gain; 3rd and 3 at your 30 yard line". For convenience, commands may have abbreviations, such as "lp" for "long pass". "Score" or "Status" commands would return the present state of the game. Thus, in this implementation the "field" may be provided by the score or status commands. The remote server may determine who is the offensive player. While the offensive player "has the ball", the defending player receives messages of defensive outcomes and/or results until it is his or her turn to call plays again.

Users could play against the server or against other users, as only one player is calling offensive plays at a time. A user could have multiple games in progress against other users. Each game in progress may be available at all times, and when a user stops sending command messages, the game may be suspended until the next command is entered. Players can send messages to each other through the server as well as directly.

On a phone, the text messaging implementation may be provided through SMS ("texting"), for example. Other "instant messaging" platforms, including AOL, Google Talk, Facebook, and the like also may be used.

While various embodiments of the invention have been described, it will be apparent to those of ordinary skill in the art that other embodiments and implementations are possible within the scope of the invention. Accordingly, the invention is not to be restricted except in light of the attached claims and their equivalents.

What is claimed is:

1. A game for simulating American football, comprising:

a single deck of action cards, each action card including offensive plays and defensive outcomes, where each of the action cards includes the same offensive plays and each of the offensive plays has a corresponding defensive outcome, where the offensive plays are presented in large text above the smaller text of the defensive outcomes, where the action cards have identical backs so that when they are placed face down they cannot be distinguished from each other, and where the action cards include a chance element of the game and the chance element is introduced by different defensive outcomes for the same offensive plays;

a field, where the field simulates an American football field and comprises:

perpendicular lines along the longitudinal length of the field reflecting 5 and 10 yard indicators to simulate ball movement along the field, holes on and staggered between the perpendicular lines of the 5 yard indicators, and holes reflecting first through fourth downs; and markers, where the markers attach removably to the holes in the field to monitor the progress of the game, where the game is played by consecutively selecting the action cards and plotting the defensive outcomes of the offensive plays with the markers on the field.

2. The game of claim 1, where the consecutively selecting of the action cards is by drawing consecutive cards from the single deck.

3. The game of claim 1, where each of the action cards only includes the offensive plays and the defensive outcomes.

4. The game of claim 3, where each of the action cards includes the offensive plays and each of the offensive plays has a single corresponding defensive outcome.

5. The game of claim 1, where the chance element introduced by the different offensive outcomes for the same offensive plays is the only chance element of the game.

6. The game of claim 1, where selection of the offensive plays introduces a strategy element.

7. The game of claim 1, where the offensive plays comprise center run, end run, short pass, long pass, punt, field goal, extra point, and kickoff.

8. The game of claim 1, where the defensive outcomes comprise a gain or loss of yardage, penalty, fumble with turn-over, fumble without turn-over, incomplete pass, quarterback sacked, punt, maximum yardage for field goal good, extra point, and kickoff yardage.

9. The game of claim 1, where the action cards comprise thirteen sets of six action cards and each one of the six action cards has different defensive outcomes than the other five of the six action cards.

10. The game of claim 1, where each of the action cards includes eight of the offensive plays, each of the eight offensive plays having a single corresponding defensive outcome.

11. The game of claim 1, where the field comprises two substrates enclosed by a foldable sheath.

12. The game of claim 1, where the field comprises multiple field cards.

13. The game of claim 1, where the action cards, field, and markers are enclosed by a box, the box sized to fit in the back pocket of a pair of pants.

14. The game of claim 13, the box further comprising playing instructions.

* * * * *